US007600845B2

(12) United States Patent
Ishizaki

(10) Patent No.: US 7,600,845 B2
(45) Date of Patent: Oct. 13, 2009

(54) PIEZOELECTRIC HEAD INSPECTION DEVICE AND DROPLET JETTING DEVICE

(75) Inventor: Sunao Ishizaki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 313 days.

(21) Appl. No.: 11/581,704

(22) Filed: Oct. 16, 2006

(65) Prior Publication Data

US 2007/0279446 A1 Dec. 6, 2007

(30) Foreign Application Priority Data

Jun. 6, 2006 (JP) ..... 2006-157243

(51) Int. Cl.
*B41J 2/01* (2006.01)

(52) U.S. Cl. ..... 347/19; 347/10; 347/68

(58) Field of Classification Search ..... 347/5, 347/9, 10, 11, 19, 65–68
See application file for complete search history.

(56) References Cited

U.S. PATENT DOCUMENTS

2005/0057596 A1* 3/2005 Shinkawa et al. ..... 347/19

FOREIGN PATENT DOCUMENTS

JP 2000-318183 11/2000
JP 2000-355100 12/2000
JP 2004-276273 10/2004
JP 2004-284191 10/2004

OTHER PUBLICATIONS

Ogo and Mita, *Shisutemu Seigyo Riron Myumon* (Introduction to System Control Theory), Jikkyo Shuppan Co., Ltd. (1979), pp. 121-130.
Ogo and Mita, *Shisutemu Seigyo Riron Nyumon* (Introduction to System Control Theory), Jikkyo Shuppan Co., Ltd. (1979), pp. 173-178.
Mita, *Dejitaru Seigyo Riron* (Digital Control Theory), Shokodo Co., Ltd. (1984), pp. 7-20.

* cited by examiner

*Primary Examiner*—Lam S Nguyen
(74) *Attorney, Agent, or Firm*—Fildes & Outland, P.C.

(57) ABSTRACT

The present invention provides an inspection device for a piezoelectric head. The piezoelectric head includes: a pressure chamber filled with liquid, a liquid supply channel that supplies the liquid to the pressure chamber, a nozzle at which droplets are jetted from the pressure chamber, and a piezoelectric element that applies pressure to the pressure chamber. The inspection device includes: a detection component that, when the piezoelectric element is driven on the basis of a predetermined detection signal, outputs a signal corresponding to behavior of an acoustic vibration system of the piezoelectric head; and a judgment component that, on the basis of the detection signal and the signal outputted by the detection component, judges for a cause of defective ejections at the piezoelectric head.

6 Claims, 16 Drawing Sheets

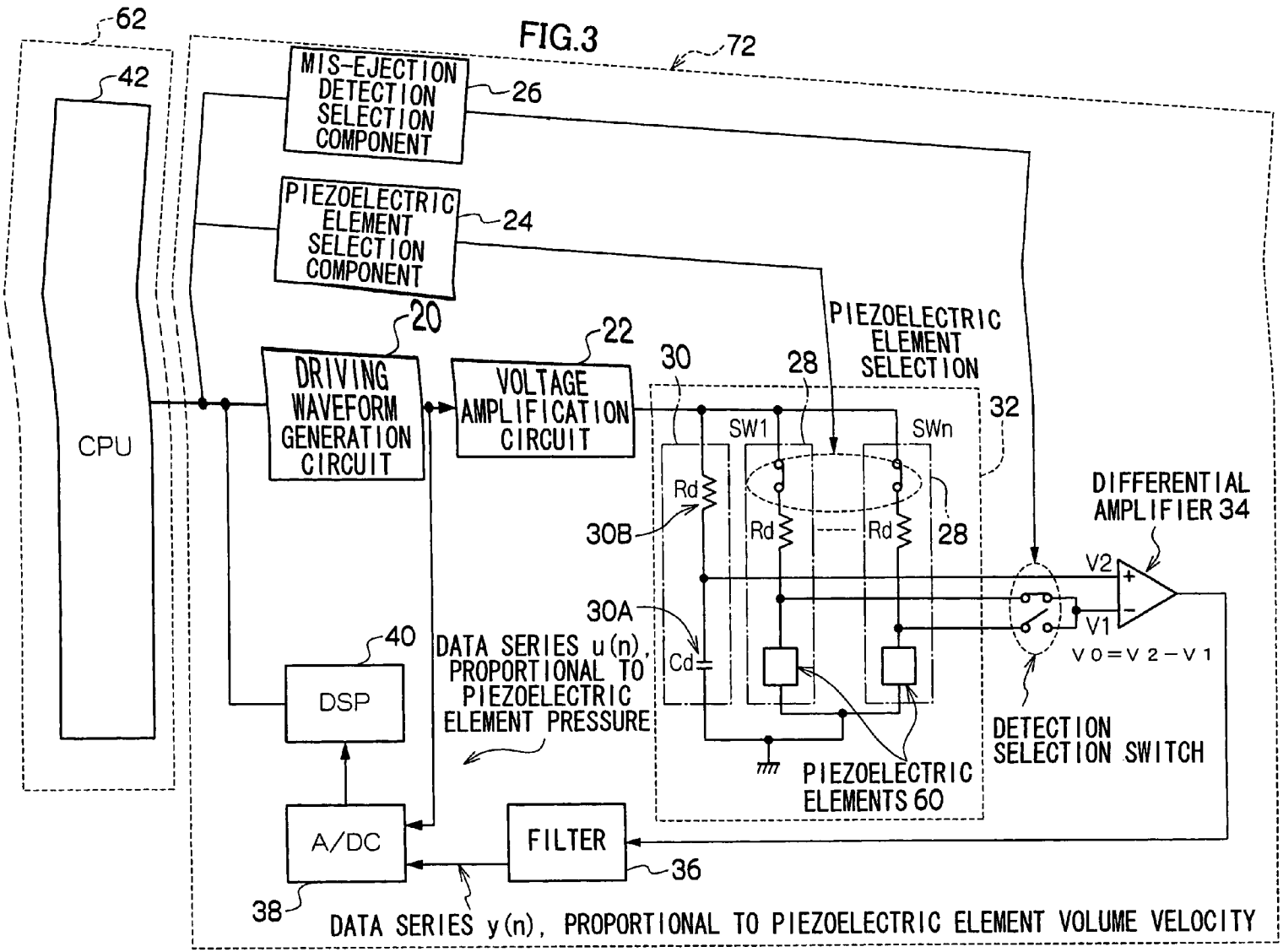
FIG.3
72
MIS-EJECTION DETECTION SELECTION COMPONENT
26
PIEZOELECTRIC ELEMENT SELECTION COMPONENT
24
DRIVING WAVEFORM GENERATION CIRCUIT
20
VOLTAGE AMPLIFICATION CIRCUIT
22
PIEZOELECTRIC ELEMENT SELECTION
32
28
SWn
SW1
Rd
Cd
30
30B
30A
PIEZOELECTRIC ELEMENTS 60
DIFFERENTIAL AMPLIFIER 34
V2
V1
V0=V2−V1
DETECTION SELECTION SWITCH
DATA SERIES u(n), PROPORTIONAL TO PIEZOELECTRIC ELEMENT PRESSURE
DSP
40
A/DC
38
FILTER
36
DATA SERIES y(n), PROPORTIONAL TO PIEZOELECTRIC ELEMENT VOLUME VELOCITY
62
42
CPU

PIEZOELECTRIC HEAD INSPECTION DEVICE AND DROPLET JETTING DEVICE

BACKGROUND

1. Technical Field

This invention relates to a piezoelectric head inspection device and a droplet jetting device, and more particularly to an inspection device and a droplet jetting device which inspect for causes of defective ejections from nozzles of piezoelectric heads.

2. Related Art

Heretofore, in a piezoelectric head which employs piezoelectric elements (piezoactuators or the like), pressure is applied in pressure chambers by the application of voltages to the piezoelectric elements, and ink drops are ejected from nozzles.

Now, when a bubble enters through an ink supply channel, an ejection failure occurs at the nozzle. In order to preemptively prevent this failure, an operation of maintenance by suction is necessary. Further, if foreign matter, such as paper dust or the like, or congealed ink or the like adheres to a nozzle face, surface tension is altered and ejection direction defects occur. Therefore, an operation of maintenance by wiping is necessary.

In a case in which it is not possible to detect occurrences of defective ejections, such as ejection failures, ejection direction defects and the like, it is necessary to perform periodic maintenance. Consequently, there is a problem in that this results in wastages of time and ink. Further, as mentioned above, maintenance operations include suction and wiping. While suction is effective for bubble removal, it is not very effective for removal of foreign matter from the nozzle face. Therefore, in a case in which it is not possible to detect causes of defective ejections, there is a risk of maintenance operations being purposeless.

Accordingly, as a method for inspecting for ejection failures, a nozzle inspection method has been known which detects ejection failures from changes in resonance points of piezoelectric elements by frequency-sweeping.

Further, as a device for inspecting for causes of defective ejections such as ejection failures, ejection direction defects and the like, a droplet ejection device has been known in which oscillations at a characteristic frequency are generated by an oscillation circuit, and which detects ejection failures, jetting irregularities and the like from changes in the frequency.

However, with the above-described technologies, it is necessary to implement Oscillations by frequency-sweeping or an oscillation circuit or the like. Therefore, it is difficult to incorporate equipment for inspecting a piezoelectric head into a droplet jetting device, and a complicated structure results.

SUMMARY

According to an aspect of the invention, there is provided an inspection device for a piezoelectric head. The piezoelectric head includes a pressure chamber filled with liquid, a liquid supply channel that supplies the liquid to the pressure chamber, a nozzle at which droplets are jetted from the pressure chamber, and a piezoelectric element that applies pressure to the pressure chamber. The inspection device includes: a detection component that, when the piezoelectric element is driven on the basis of a predetermined detection signal, outputs a signal corresponding to behavior of an acoustic vibration system of the piezoelectric head; and a judgment component that, on the basis of the detection signal and the signal outputted by the detection component, judges for a cause of defective ejections at the piezoelectric head.

BRIEF DESCRIPTION OF THE DRAWINGS

Exemplary embodiments of the present invention will be described in detail based on the following figures, wherein:

FIG. 3 is a schematic view showing a first structure of a detection component relating to the first exemplary embodiment of the present invention;

DETAILED DESCRIPTION

Herebelow, an exemplary embodiment of the present invention will be described in detail with reference to the drawings. For this exemplary embodiment, a case of inspecting an inkjet recording head which is employed at an inkjet recording device will be described.

Figure 1:
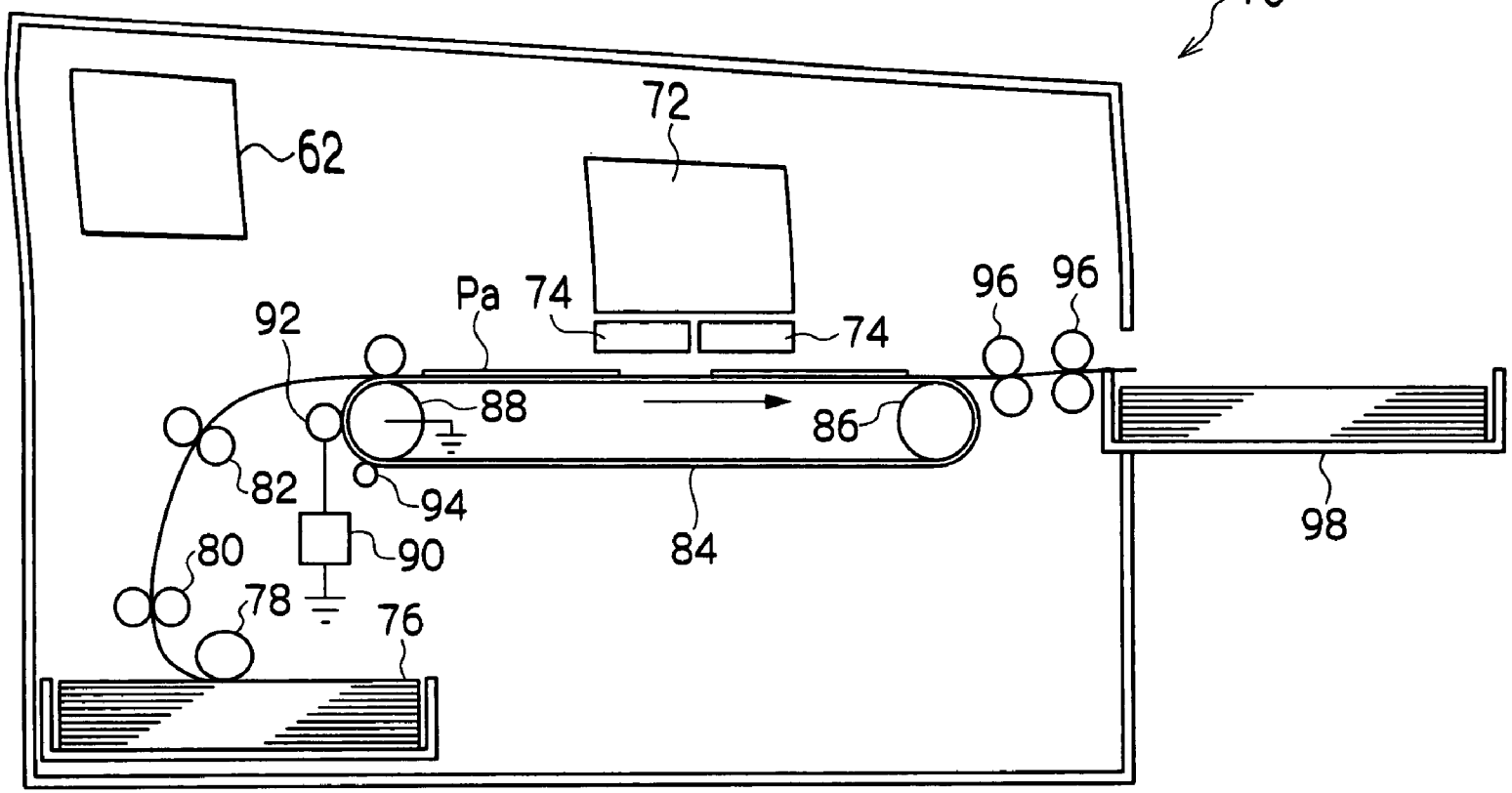
FIG. 1 is a front view showing structure of an inkjet recording device relating to a first exemplary embodiment of the present invention.

As shown in FIG. 1, an inkjet recording device 70 relating to a first exemplary embodiment is provided with an inkjet head unit 72 which ejects ink drops at a recording paper Pa. At the inkjet head unit 72, a recording head array is provided in which a plurality of piezoelectric-type inkjet recording heads, which eject ink drops of the four colors cyan (C), magenta (M), yellow (Y) and black (K) from nozzles 58 (see FIG. 2), are arrayed.

At a lower portion of the inkjet head unit 72, maintenance units 74 are provided. The maintenance units 74 are provided to be capable of opposing nozzle faces of the recording head array, or provided to be capable of moving to positions opposing the same.

At a lowermost portion of the inkjet recording device 70, a paper supply tray 76 is removably provided. Recording paper Pa is placed on the paper supply tray 76, and a pickup roller 78 abuts against an uppermost recording paper Pa. The recording paper Pa is supplied to a conveyance direction downstream side from the paper supply tray 76 by the pickup roller 78, one sheet at a time, and is supplied to below the inkjet head unit 72 by conveyance rollers 80 and 82, which are provided in this order along a conveyance path.

An endless-type conveyance belt 84 is disposed below the inkjet head unit 72. The conveyance belt 84 spans between a driving roller 86 and a driven roller 88. The driven roller 88 is earthed.

A charging roller 92 is disposed at an upstream side relative to a position at which the recording paper Pa touches against the conveyance belt 84. A DC power supply apparatus 90, which supplies DC electric power, is connected to the charging roller 92. The charging roller 92 nips the conveyance belt 84 between the charging roller 92 and the driven roller 88 and is passively driven, and is movable between a touching position which touches against the conveyance belt 84 and a separated position which is separated from the conveyance belt 84. At the touching position, there is a predetermined potential difference between the charging roller 92 and the earthed driven roller 88. Consequently, the charging roller 92 discharges and supplies electrical charge to the conveyance belt 84.

A charge removal roller 94 is provided for removing charge that has been charged onto the conveyance belt 84, at an upstream side relative to the charging roller 92.

A plurality of ejection roller pairs 96 structuring an ejection path of the recording paper Pa is provided at a downstream side of the inkjet head unit 72, and a paper ejection tray 98 is provided at the end of the ejection path structured by the ejection roller pairs 96.

At the inkjet recording device 70, a control unit 62 is provided, which is structured with a CPU, ROM and RAM. Overall control of the inkjet recording device 70, including the inkjet head unit 72 and a plurality of motors for driving the various rollers, is performed by the control unit 62.

Figure 2:
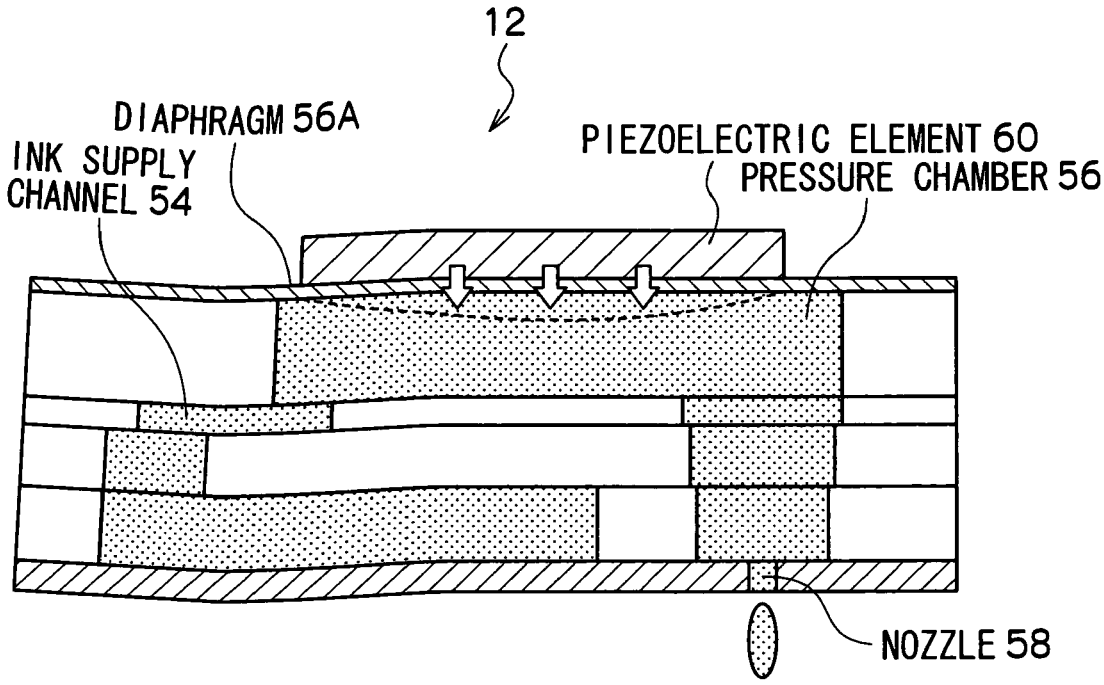
FIG. 2 is a sectional view showing structure of a piezoelectric head relating to the first exemplary embodiment of the present invention.

The recording head array of the inkjet head unit 72 is provided with a plurality of piezoelectric-type inkjet recording heads 12 as shown in FIG. 2 (below referred to as piezoelectric heads). Each piezoelectric head 12 features an ink supply channel 54 for supplying ink to a pressure chamber 56, the pressure chamber 56 which is filled with ink, a nozzle 58 which ejects ink from the pressure chamber 56, and a piezoelectric element (piezoactuator) 60 which applies pressure to the pressure chamber. The interior of the pressure chamber 56 is pressurized by the piezoelectric element 60, and thus an ink drop is ejected from the nozzle 58.

The inkjet head unit 72 is also provided with ink tanks which are filled with ink. The inks with which the ink tanks are filled are loaded into the pressure chambers 56 via the ink supply channels 54, and the ink is supplied to the nozzles 58, which communicate with the pressure chambers 56.

Part of a wall face of the pressure chamber 56 is constituted by a diaphragm 56A, and the piezoelectric element 60 is disposed at the diaphragm 56A. The diaphragm 56A is altered by the piezoelectric element 60 and caused to move, and hence applies pressure to the pressure chamber 56. That is, when pressure is applied due to oscillation of the diaphragm 56A by the piezoelectric element 60, ink which has been loaded into the pressure chamber 56 is ejected from the nozzle 58 as ink drops, and the ink in the pressure chamber 56 is replenished from the ink tank via the ink supply channel 54.

Figure 15:
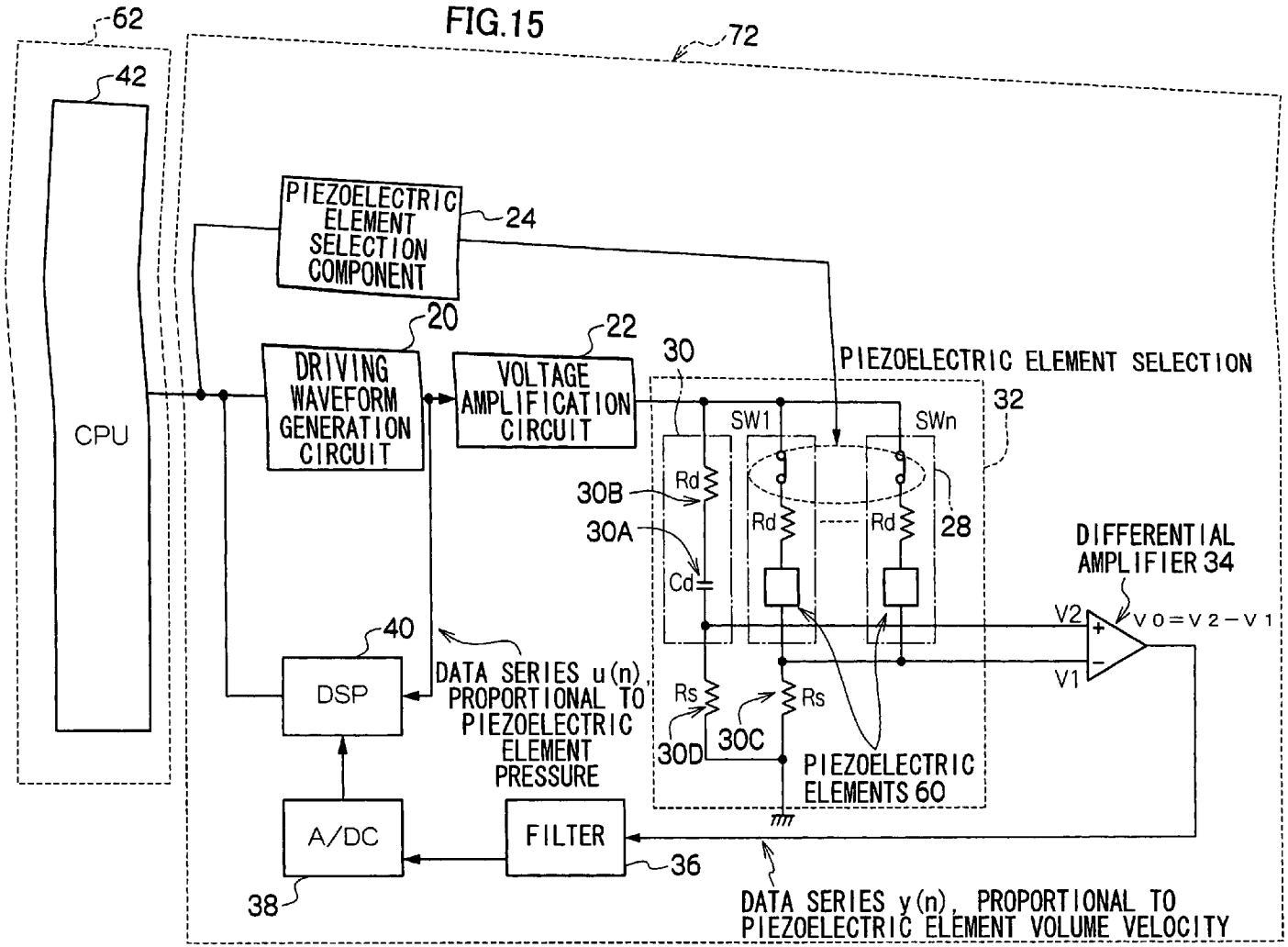
FIG. 15 is a schematic view showing a second structure of the detection component relating to the first exemplary embodiment of the present invention.

There are, for example, 1,024 of the nozzles 58 at the piezoelectric heads 12. The nozzles 58 are, for example, plurally arrayed in a recording paper width direction. The nozzles 58 can record an image at recording paper, by recording images in the recording paper width direction with the recording paper relatively moving with respect to the recording head. At each nozzle 58, the pressure chamber 56, the diaphragm 56A, the piezoelectric element 60 and an electrode are provided. The inkjet head unit 72 is provided with a detection component which, as shown in FIG. 3 or FIG. 15, is structured with a driving waveform generation circuit 20 which generates a driving signal required for printing and a test signal for detection of defective ejection causes, a voltage amplification circuit 22 which amplifies the driving signal and the test signal to voltages which are capable of driving the piezoelectric elements 60, a bridge circuit 32 which will be described below, and a differential amplifier 34. Herein, the test signal that is employed is, for example, a liquid surface-oscillating waveform for times of non-printing (for example, times between paper sheets). In a first structure of the detection component, as shown in FIG. 3, the inkjet head unit 72 is provided with a piezoelectric element selection component 24 and a mis-ejection detection selection component 26. During printing, the piezoelectric element selection component 24 selects the piezoelectric elements 60 of the piezoelectric heads 12 that are to jet ink drops, on the basis of printing image information. The mis-ejection detection selection component 26 selects the piezoelectric elements 60 for performing detection of causes of defective ejections. At a time of detection of defective ejection causes, the piezoelectric element selection component 24 sets all of piezoelectric element selection switches SW1 to SWn to on, and the mis-ejection detection selection component 26 sequentially chooses detection selection switches to be turned on and off (such that it is not possible for two of the piezoelectric elements 60 to be simultaneously selected).

The inkjet head unit 72 is provided with the bridge circuit 32, in which a plurality of first series circuits 28 and a second series circuit 30 are connected in parallel. The first series circuits 28 connect the piezoelectric elements 60 of the piezoelectric heads 12 with the piezoelectric element selection switches SW in series. The second series circuit 30 connects a capacitor 30A, with an electrostatic capacitance Cd which corresponds to a damping capacitance of the piezoelectric element 60, in series with a resistor 30B, corresponding to on-resistances Rd of the piezoelectric element selection switches SW. The inkjet head unit 72 is also provided with the differential amplifier 34, which amplifies a differential voltage generated in the bridge circuit 32 between a voltage between the piezoelectric element selection switch SW and the piezoelectric element 60 of one of the first series circuits 28 and a voltage between the capacitor 30A and the resistor 30B.

Now, in a second structure of the detection component, as shown in FIG. 15, the inkjet head unit 72 is provided with the piezoelectric element selection component 24 for selecting the piezoelectric elements 60 of the piezoelectric heads 12 which are to jet ink drops on the basis of printing image information at times of printing. At a time of detection of defective ejection causes, this piezoelectric element selection component 24 sequentially chooses the piezoelectric element selection switches SW1 to SWn (such that it is not possible for two of the piezoelectric elements 60 to be simultaneously selected).

The inkjet head unit 72 is provided with the bridge circuit 32. This bridge circuit 32 is provided with the first series circuits 28, a first current detection resistor 30C, the second series circuit 30 and a second current detection resistor 30D. The first series circuits 28 connect the piezoelectric elements 60 of the piezoelectric heads 12 with the Piezoelectric element selection switches SW in series. The second series circuit 30 connects the capacitor 30A, with the capacitance Cd which corresponds to the damping capacitances of the piezoelectric elements 60, with the resistor 30B, corresponding to the on-resistances Rd of the piezoelectric element selection switches SW, in series. The plurality of first series circuits 28 is connected in series with the first current detection resistor 30C, and the second series circuit 30 is connected in series with the second current detection resistor 30D. The plurality of first series circuits 28 and the first current detection resistor 30C are connected in parallel with the second series circuit 30 and the second current detection resistor 30D. The inkjet head unit 72 is further provided with the differential amplifier 34, which amplifies a differential voltage of the bridge circuit 32 between a voltage applied to the first current detection resistor 30C and a voltage applied to the second current detection resistor 30D.

In the detection component of either of the structures described above, the inkjet head unit 72 is provided with a filter 36 and an A/D converter 38. The filter 36 is a low-pass filter for noise elimination and aliasing due to sampling elimination. The A/D converter 38 converts a voltage signal which is applied to the piezoelectric element selection switches SW and the resistor 30B of the bridge circuit 32 and a signal which is an output signal of the differential amplifier 34 that has passed through the filter 36 to digital signals.

The inkjet head unit 72 is also provided with a DSP (digital signal processor) 40 which performs various kinds of signal processing. The DSP 40 samples a test signal, which represents the voltage applied to the piezoelectric element selection switches SW and the resistor 30B of the bridge circuit 32, and the output signal of the differential amplifier 34 with a certain sampling interval (sampling period). Here, the sampling frequency must be at least twice maximum frequencies of the test signal and the output signal that are being sampled, and is therefore, for example, 4 MHz.

A CPU 42 of the control unit 62 controls the mis-ejection detection selection component 26, the piezoelectric element selection component 24 and the driving waveform generation circuit 20, and performs control of the overall device on the basis of processing results from the DSP 40.

Figure 4:
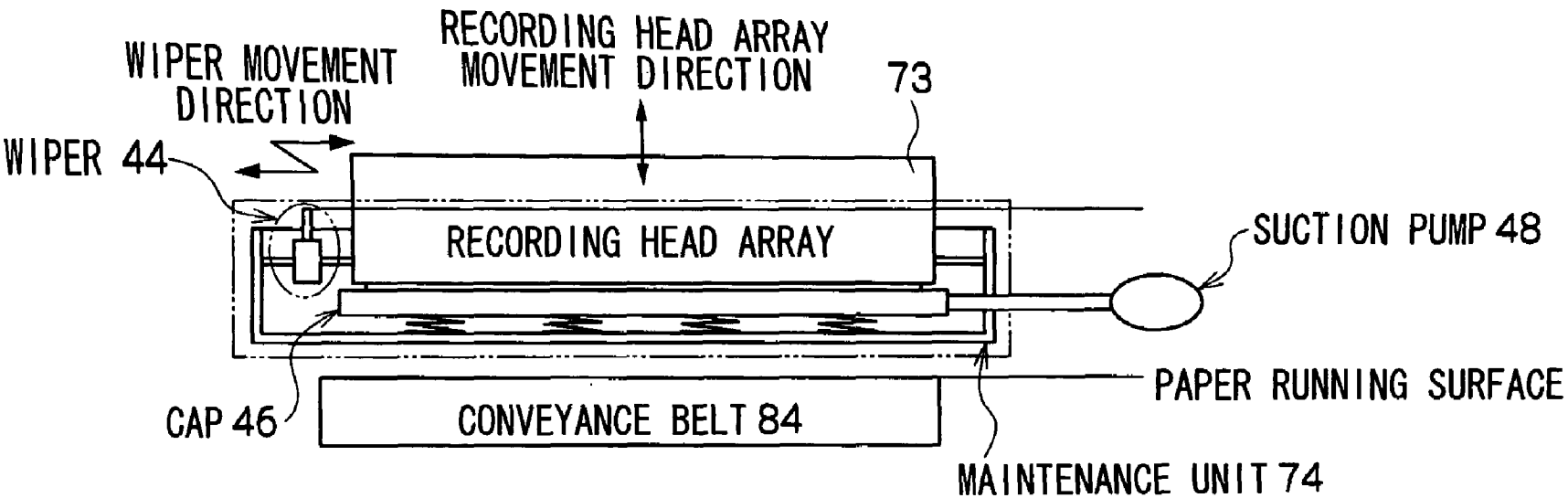
FIG. 4 is a side view showing structure of a maintenance unit relating to the first exemplary embodiment of the present invention.

Each maintenance unit 74, as shown in FIG. 4, is provided with a wiper 44, a cap 46, a dummy jet-catching member and the like. For an operation of maintenance by wiping, a recording head array is raised, and the wiper 44 reaches a position which touches against a nozzle face. In this state, the wiper 44 is reciprocatingly moved parallel to the nozzle face, and thus foreign matter such as ink, paper dust and the like that is present at the nozzle face is wiped off. As a result, surface tensions at opening portions of the nozzles 58 can be kept correct.

Here, 'foreign matter' means ink which has congealed, dried solid or the like, paper dust, combinations thereof and other adherents.

For an operation of maintenance by suction, the recording head array descends, and the piezoelectric heads 12 are housed in the cap 46. A suction pump 48 is attached to the cap 46, and bubbles that have entered into the pressure chambers 56 of the piezoelectric heads 12 are extracted therewith through the opening portions of the nozzles 58.

Figure 5:
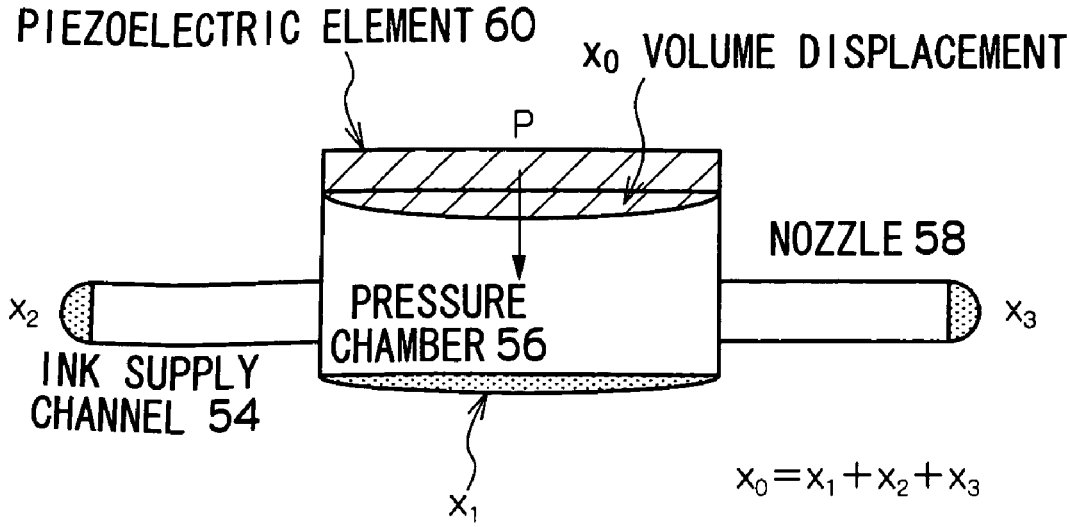
FIG. 5 is a theoretical view for describing an acoustic vibration system model of the piezoelectric head relating to the first exemplary embodiment of the present invention.

Next, an acoustic vibration system model of the piezoelectric head 12 will be described. First, as shown in FIG. 5, when a voltage is applied to the piezoelectric element 60, a pressure P is generated and, as a result, volume changes are caused at the piezoelectric element 60, the ink supply channel 54, the pressure chamber 56 and the nozzle 58. If the respective volume changes of the piezoelectric element 60, pressure chamber 56, ink supply channel 54 and nozzle 58 at this time are represented by $x_0$, $x_1$, $x_2$ and $x_3$ and a case is assumed in which the voltage is small and ink is not ejected from the nozzle 58, $x_0=x_1+x_2+x_3$. Here, $x_0$, $x_1$ and $x_2$ are independent variables.

Now, if a state vector which is constituted of $x_0$ and an arbitrary two of the variables $x_1$, $x_2$ and $x_3$ is 'x', an inertia matrix of the piezoelectric element 60, the pressure chamber 56, the ink supply channel 54 and the nozzle 58 of the acoustic vibration system is 'M', a viscosity matrix of the same is 'R' and a rigidity matrix of the same is 'K', and a pressure vector which the piezoelectric element 60 applies to the pressure chamber 56 when voltage is applied to the piezoelectric element selection switch SW of the bridge circuit 32 is 'P', then an equation of state of the acoustic vibration system is the following equation.

$$P = M\frac{d^2x}{dt^2} + R\frac{dx}{dt^2} + Kx \tag{1}$$

Figure 6:
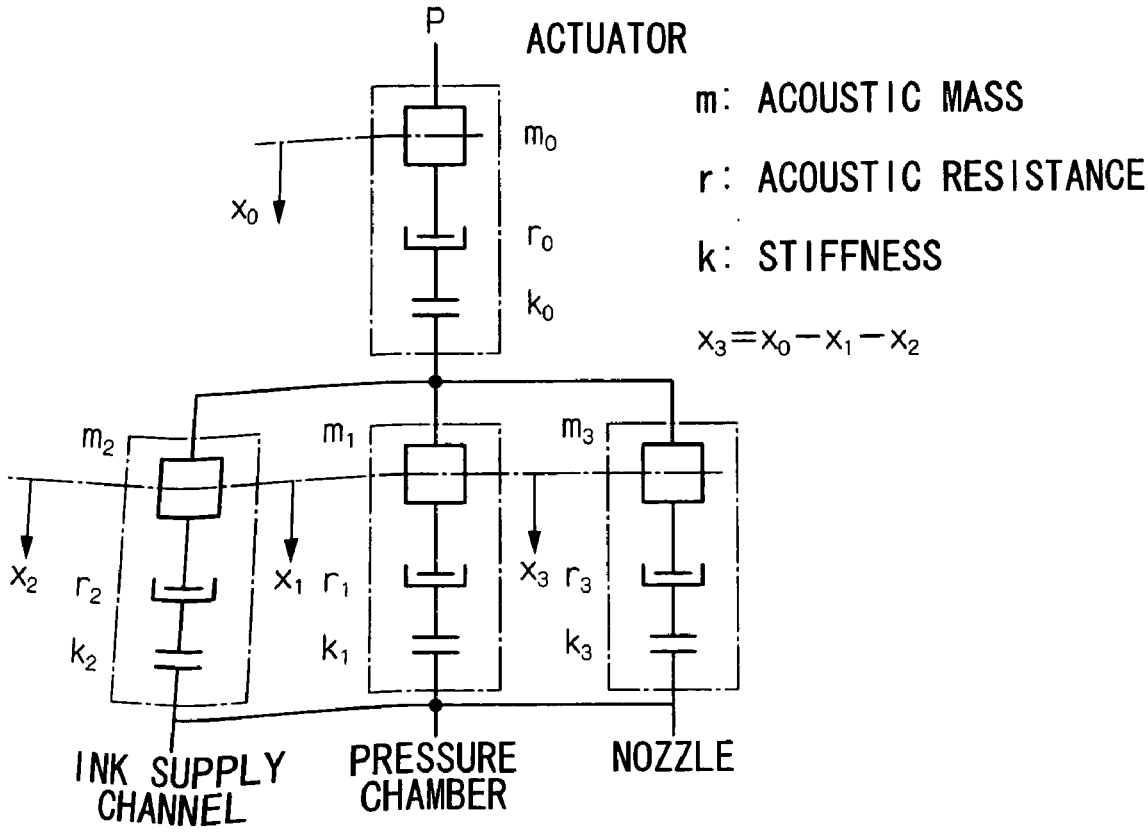
FIG. 6 is a theoretical view for describing the acoustic vibration system model of the piezoelectric head relating to the first exemplary embodiment of the present invention.

As shown in FIG. 6, acoustic masses (inertial elements) of the piezoelectric element 60, the ink supply channel 54, the pressure chamber 56 and the nozzle 58 are $m_i$, acoustic resistances (viscosity elements) are $r_i$ and acoustic stiffnesses (rigidity elements) are $k_i$ (i=0,1,2,3). The acoustic stiffness $k_3$ of the nozzle 58 is an element which influences a surface tension which acts at liquid at the face of the nozzle 58.

Because an external force on this acoustic vibration system is the pressure force P which is applied to the pressure chamber 56 from the piezoelectric element 60, the acoustic vibration system can be represented by the following equation of state.

$$\begin{bmatrix} P \\ 0 \\ 0 \end{bmatrix} = \frac{d^2}{dt^2}\begin{bmatrix} m_0+m_3 & -m_3 & -m_3 \\ -m_3 & m_1+m_3 & m_3 \\ -m_3 & m_3 & m_2+m_3 \end{bmatrix}\begin{bmatrix} x_0 \\ x_1 \\ x_2 \end{bmatrix} + \frac{d}{dt}\begin{bmatrix} r_0+r_3 & -r_3 & -r_3 \\ -r_3 & r_1+r_3 & r_3 \\ -r_3 & r_3 & r_2+r_3 \end{bmatrix}\begin{bmatrix} x_0 \\ x_1 \\ x_2 \end{bmatrix} + \begin{bmatrix} k_0+k_3 & -k_3 & -k_3 \\ -k_3 & k_1+k_3 & k_3 \\ -k_3 & k_3 & k_2+k_3 \end{bmatrix}\begin{bmatrix} x_0 \\ x_1 \\ x_2 \end{bmatrix} \quad (2)$$

Next, defective ejections of the piezoelectric head 12 relating to this exemplary embodiment will be described. As the defective ejections, ejection failures and ejection direction defects will be described.

A cause of an occurrence of ejection failure is the ingression of a bubble into the pressure chamber 56, the ink supply channel 54 or the nozzle 58. Causes of an occurrence of an ejection direction defect are a change in surface tension, due to adherence of foreign matter such as paper dust or the like at the face of the nozzle 58 or hardening of ink due to congealing, drying, mixing with paper dust or the like, and an abnormality in surface tension from a time of fabrication, due to a defect in the shape of the nozzle, a defect in a water-repellence treatment or the like.

Figure 7:
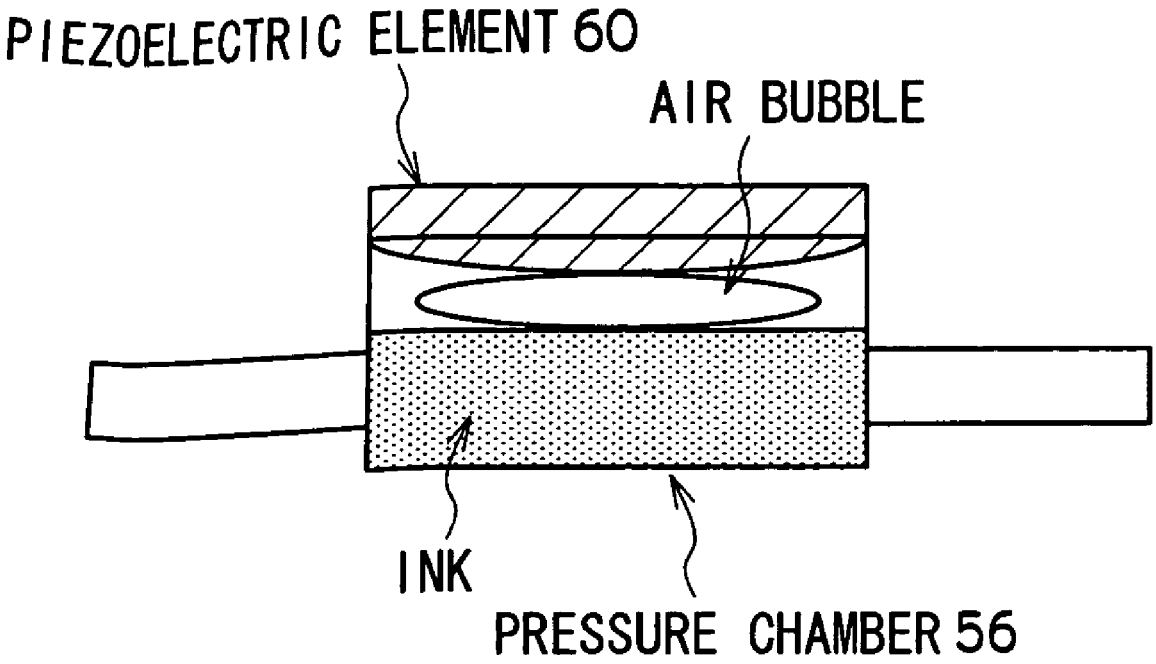
FIG. 7 is a theoretical view showing a case in which a bubble has ingressed into a pressure chamber.
Figure 8A:
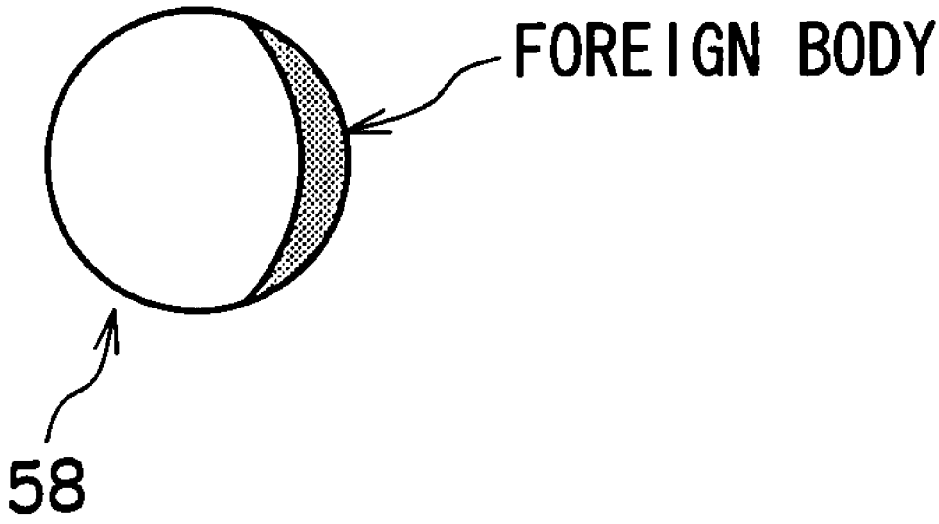
FIG. 8A is a theoretical view for explaining a circumferential length of a nozzle when foreign matter has adhered to a nozzle face.
Figure 8B:
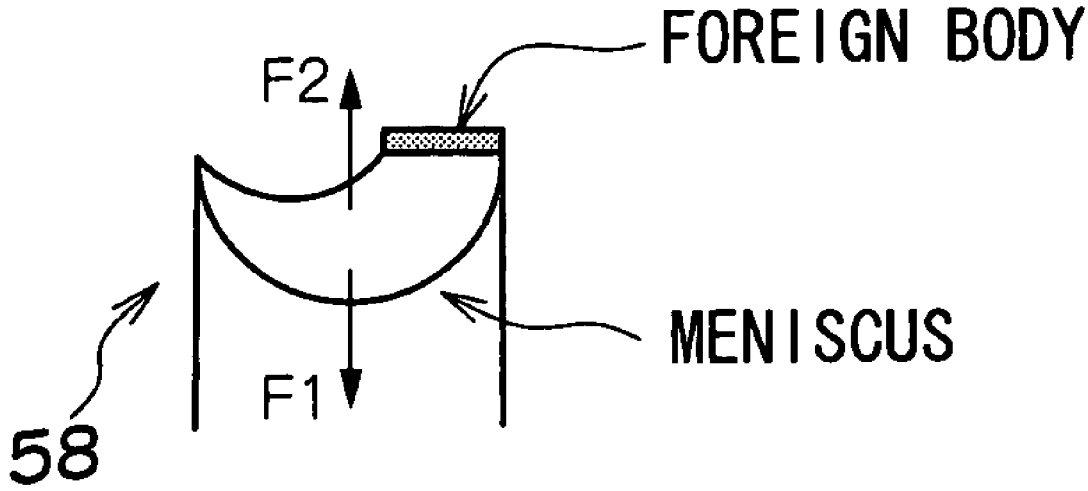
FIG. 8B is a theoretical view showing a state of a meniscus at a nozzle.

As shown in FIG. 7 when a bubble ingresses into the pressure chamber 56, the bubble acts as an air spring and the piezoelectric element 60 applies pressure to the pressure chamber 56 via the bubble acting as an air spring. In the acoustic vibration system model of FIG. 6, this can be thought of as a lowering of the stiffness (rigidity) $k_l$ of the pressure chamber 56. On the other hand, when a bubble ingresses into the supply channel or the nozzle, a volume of ink falls in accordance with a volume of the bubble and therefore the acoustic mass is reduced. Meanwhile, as shown in FIG. 8B, at a boundary surface (meniscus) of the nozzle 58, a tension force F1 due to surface tension and a pressure force F2 of an ink drop from the ink supply channel 54 balance out. Because the tension force F1 is proportional to a circumferential length of the nozzle 58, if foreign matter adheres to the face of the nozzle 58 and the circumferential length of the nozzle 58 becomes smaller, as shown in FIG. 8A, the tension force F1 falls.

When an ink drop is ejected, the ink in the nozzle 58 is reduced, and consequently ink is supplied. At this time, the meniscus oscillates by resilience due to an inertial force according to the acoustic mass of the nozzle 58 and the tension force F1. The smaller the resilience, the longer a period of this oscillation. Defects in the shape of the nozzle, a condition of water-repellence and the like are also causes which alter the surface tension.

That is, a duration until the meniscus stabilizes is made longer by adherence of foreign matter to the face of the nozzle 58, fabrication conditions and the like, and further jettings will occur while the meniscus is not stable. In consequence, destabilization of proper jetting amounts, satelliting and the like will occur, and ejection direction defects will occur.

Figure 9A:
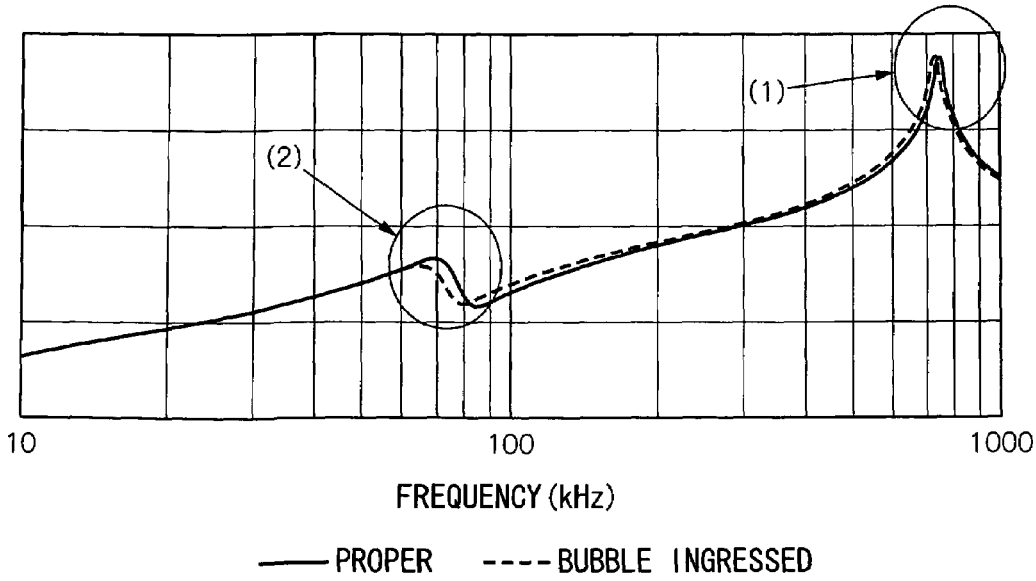
FIG. 9A is a graph showing a frequency characteristic of a rate of volume change of a piezoelectric element in a case in which a bubble has ingressed.
Figure 9B:
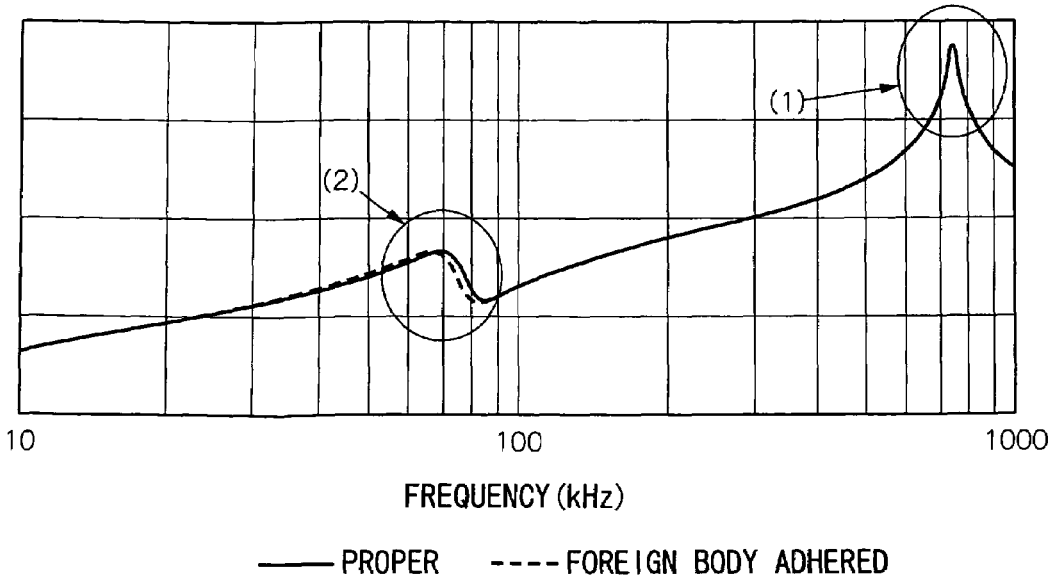
FIG. 9B is a graph shoving a frequency characteristic of a rate of volume change of the piezoelectric element in a case in which foreign matter has adhered.

Now, frequency characteristics of rates of volume change of the piezoelectric element 60 (volume changes per unit time), as shown in FIGS. 9A and 9B, show a resonance point of the piezoelectric element (see peak 1 in FIGS. 9A and 9B) and a resonance point of a flow-path system made up of the ink supply channel 54, the pressure chamber 56 and the nozzle 58 (a characteristic frequency, see peak 2 in FIGS. 9A and 9B). Meanwhile, in frequency characteristics of rates of volume change of the piezoelectric element 60 when bubble ingression, foreign matter adherence or a fabrication defect has occurred, as shown in FIG. 9A, the characteristic frequency (peak 2) changes with a bubble ingression, but as shown in FIG. 9B, with foreign matter adherence or a fabrication defect, there is hardly any change from the regular case. Therefore, foreign matter adherences and fabrication defects, that is, ejection direction defects, cannot be detected from frequency characteristics of rates of volume change of the piezoelectric elements 60.

Figure 10A:
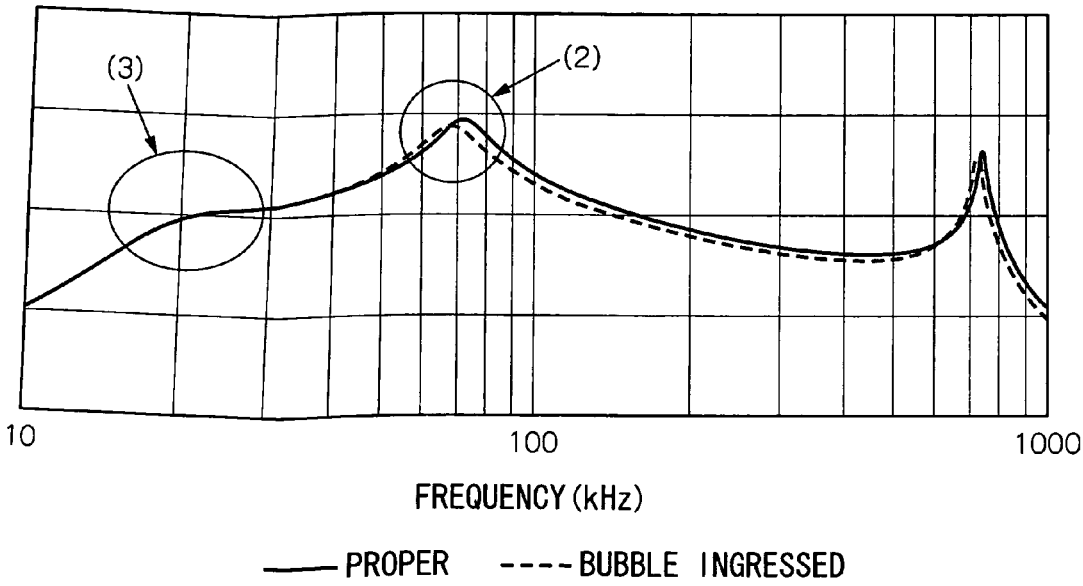
FIG. 10A is a graph showing a frequency characteristic of a flow speed of jetted ink drops in a case in which a bubble has ingressed.
Figure 10B:
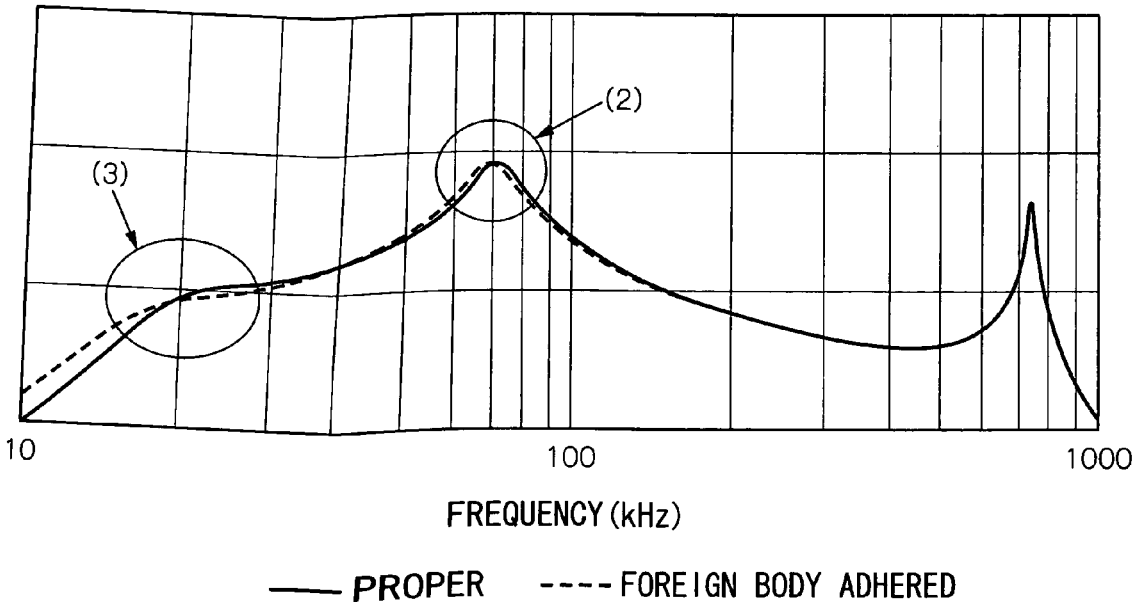
FIG. 10B is a graph showing a frequency characteristic of a flow speed of jetted ink drops in a case in which foreign matter has adhered.

Next, graphs representing frequency characteristics of flow speeds of ink drops jetted from the nozzle 58, which are calculated from the above-mentioned equation (2), will be described using FIGS. 10A and 10B. An inflection point shown in FIGS. 10A and 10B (see peak 3 in FIGS. 10A and 10B) is a resonance point of oscillations when ink is supplied to the nozzle 58 (referred to as a refill frequency). In frequency characteristics of flow speed of ink drops jetted from the nozzle 58 when a bubble ingression or foreign matter adherence has occurred, as shown in FIG. 10A, the characteristics frequency (peak 2) is changed by bubble ingression and, as shown in FIG. 10B, the refill frequency (peak 3) is changed by foreign matter adherence. Therefore, both bubble ingressions and foreign matter adherences can be detected.

Hererein, it is sufficient for the inkjet recording device 70 to be provided with the structure and functions of an ordinary inkjet recording device. Descriptions of the ordinary structure and functions of the inkjet recording device 70 will not be given.

Next, operations of the inkjet recording device 70 relating to the first exemplary embodiment will be described. Here, a case of detecting causes of defective ejections of the piezoelectric heads 12 will be described.

Firstly, as shown for the first structure of the detection component in FIG. 3, the piezoelectric element selection switches SW1 to SWn are all turned on by the piezoelectric element selection component 24, and a detection selection switch corresponding to any piezoelectric head 12 is turned on by the ejection failure detection selection component 26.

Then, a test signal is generated by the driving waveform generation circuit 20, voltage thereof is amplified by the voltage amplification circuit 22, and this voltage is applied to the bridge circuit 32. The voltage is applied through the resistance Rd to the capacitor Cd and the voltage is applied through the piezoelectric element selection Switches SW to the piezoelectric elements 60 of the piezoelectric heads 12.

On the other hand, as shown for the second structure of the detection component in FIG. 15, any one of the piezoelectric element selection switches SW1 to SWn is turned on by the piezoelectric element selection component 24. Then, a test signal is generated by the driving waveform generation circuit 20, voltage thereof is amplified by the voltage amplification circuit 22, and this voltage is applied to the bridge circuit 32. The voltage is applied through the resistance Rd to the capacitor Cd and the voltage is applied through the piezoelectric element selection switch SW to the piezoelectric element 60 of the piezoelectric head 12.

Then, with the detection component of either of the above-mentioned structures, processing is carried out at the DSP 40 for judging for causes of defective ejections. The processing for judging for causes of defective ejections is described herebelow.

In the processing for judging for causes of defective ejections, firstly, a flow speed or flow amount of ink drops which are jetted from the nozzle 58 is estimated. Now, a pressure that is applied to the pressure chamber 56 by the piezoelectric element 60 is proportional to an applied voltage, and a rate of volume change of the piezoelectric element 60 is proportional to current flowing in the piezoelectric element 60. Therefore, it is possible to measure a rate of volume change of the piezoelectric element 60 by sensing current that flows in the piezoelectric element 60. However, it is not possible to directly electrically sense the flow speed or flow amount of the ink drops jetted from the nozzle 58.

Accordingly, in this exemplary embodiment, a flow speed or flow amount of ink drops jetted from the nozzle 58 is estimated, from the rate of volume change of the piezoelectric element 60 when a certain voltage signal is applied, on the basis of the equation of state of the above-mentioned equation (2). A method for this estimation will be described.

Figure 11:
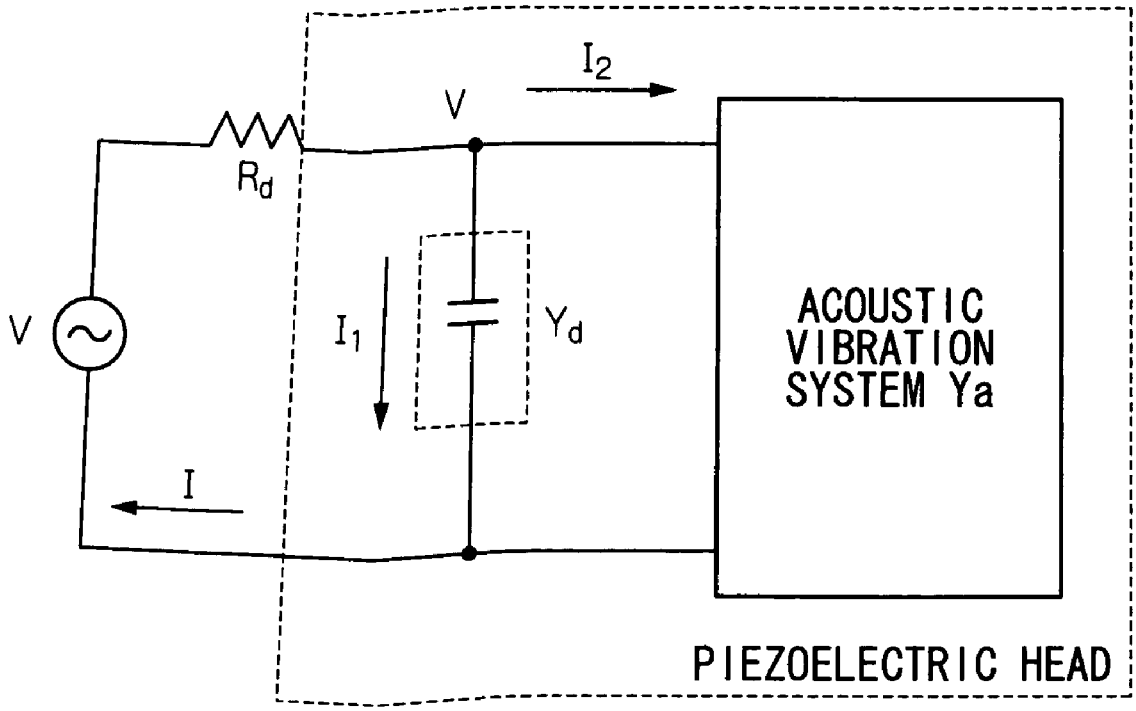
FIG. 11 is a theoretical view for describing a driving model of the piezoelectric head relating to the first exemplary embodiment of the present invention.
Figure 12:
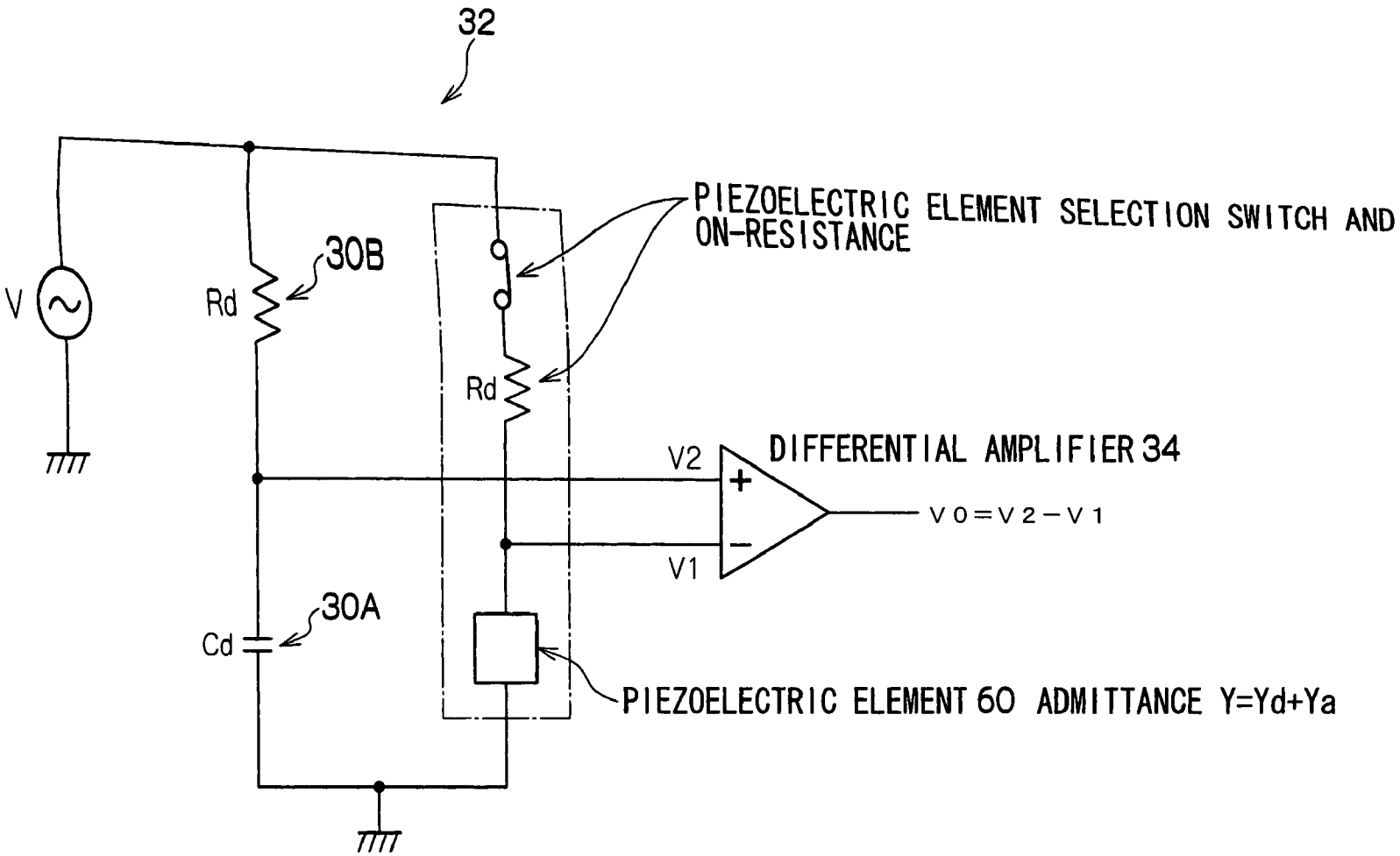
FIG. 12 is a circuit diagram for explaining structure of a bridge circuit in the first structure of the detection component relating to the first exemplary embodiment of the present invention.

First, in a driving model of the piezoelectric head 12 which is shown in FIG. 11, if an admittance according to a damping capacitance which is an electrical characteristic of the piezoelectric element 60 is Yd, a voltage applied to the acoustic vibration system is V and a current that flows therein is $I_2$, then the voltage V and the current $I_2$ are respectively proportional to generated pressure and to the rate of volume change of the piezoelectric element 60. Therefore, an admittance characteristic of the acoustic vibration system is actually the frequency characteristic shown in FIGS. 9A and 9B, and if the current $I_2$ can be measured, then the rate of volume change of the piezoelectric element 60 can be measured. In the detection component of the first structure, as shown in FIG. 12, the resistor 30B corresponding to the on-resistance Rd of the piezoelectric element selection switch and the capacitor 30A corresponding to the damping capacitance Cd of the piezoelectric element 60 are provided at the bridge circuit 32, separately from the piezoelectric head 12. Therefore, a differential output V2−V1 of this bridge circuit 32 is provided by the following equation (3), and is proportional to an admittance Ya of the acoustic vibration system.

$$V_O = V_1 - V_2 = F(s)R_d Y_a V \tag{3}$$

$$F(s) = \frac{\omega_d}{s + \omega_d} \tag{4}$$

$$\omega_d = C_d R_d \tag{5}$$

Here, the variable s, in terms of frequency f and the imaginary unit $j=\sqrt{-1}$, is $s=j2\pi f$. In the above equations (3) to (5), F(s) is the transfer function of a low-pass filter which is structured by the resistance Rd and the damping capacitance Cd. A cutoff frequency $\omega_d/2\pi$ of this filter is several MHz. In contrast, the characteristic frequency and the refill frequency of the flow-path system are at most a hundred kHz. Therefore, the region of these frequencies is in the transmission region of this low-pass filter, and it is apparent that $F(s)\approx 1$.

Now, using the driving voltage V and the admittance Ya, the current $I_2$ that flows into the acoustic vibration system Ya can be expressed by the following equation.

$$I_2 = Ya \times V$$

Therefore, the differential output V0 of the bridge circuit 32 can be represented by the following equation (6).

$$V_o \approx R_d Y_a V = R_d I_2 \tag{6}$$

Now, V is already known, and Ya can be detected. Therefore, $I_2$, and hence the rate of volume change of the piezoelectric element 60, can be measured.

Figure 16:
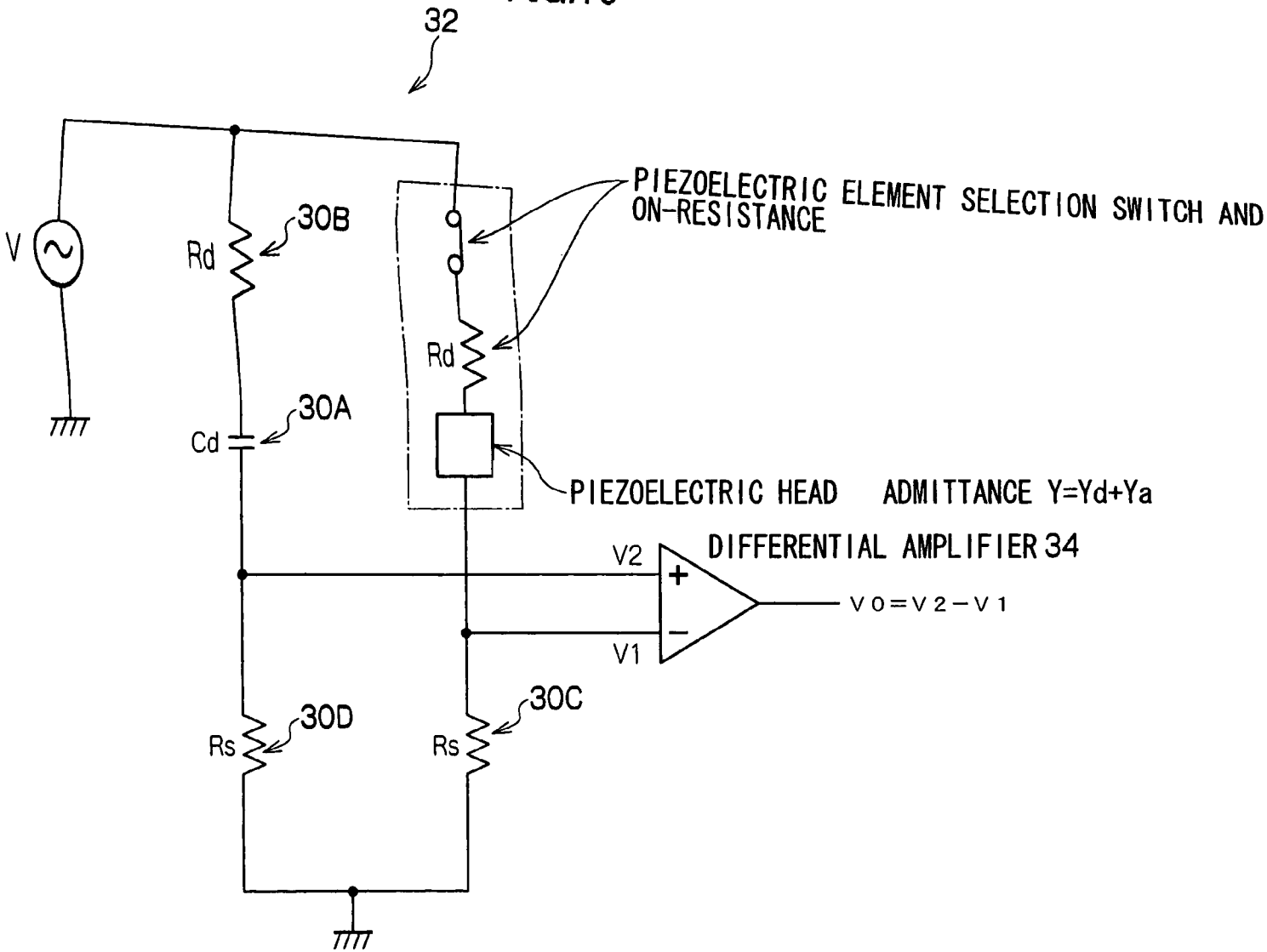
FIG. 16 is a circuit diagram for explaining structure of a bridge circuit in the second structure of the detection component relating to the first exemplary embodiment of the present invention.

Anyway, in the second structure of the detection component, as shown in FIG. 16, the resistor 30B corresponding to the on-resistance Rd of the piezoelectric element selection switch and the capacitor 30A corresponding to the damping capacitance Cd of the piezoelectric element 60 are provided at the bridge circuit 32, separately from the piezoelectric head 12, and a voltage proportional to current that flows in the piezoelectric element and the capacitor occurs at the current detection resistors 30C and 30D. Now, if a resistance value Rs of the current detection resistors 30C and 30D is set so as to be sufficiently small relative to the on-resistance Rd of the piezoelectric element selection switch, then the differential output V2−V1 of the bridge circuit 32, the differential output V0, and the transmission characteristic of a low-pass filter are provided by equations (3) to (6).

Furthermore, a rate of volume change of the nozzle 58 can be estimated on the basis of the voltage applied to the piezoelectric element 60 and the measured rate of volume change of the piezoelectric element 60. Next, a method for estimation of the rate of volume change of the nozzle 58 utilizing a state observer will be described.

Firstly, the aforementioned equation (2) is converted to equation (8), in accordance with the following equations (7) and (9).

$$M = \begin{bmatrix} m_0 + m_3 & -m_3 & -m_3 \\ -m_3 & m_1 + m_3 & m_3 \\ -m_3 & m_3 & m_2 + m_3 \end{bmatrix}, \tag{7}$$

$$R = \begin{bmatrix} r_0 + r_3 & -r_3 & -r_3 \\ -r_3 & r_1 + r_3 & r_3 \\ -r_3 & r_3 & r_2 + r_3 \end{bmatrix}, K = \begin{bmatrix} k_0 + k_3 & -k_3 & -k_3 \\ -k_3 & k_1 + k_3 & k_3 \\ -k_3 & k_3 & k_2 + k_3 \end{bmatrix}$$

$$P\begin{bmatrix} 1 \\ 0 \\ 0 \end{bmatrix} = M\frac{d^2}{dt^2}x + R\frac{d}{dt}x + Kx \tag{8}$$

$$x = [\, x_0 \quad x_1 \quad x_2 \,]^T \tag{9}$$

The above equation (8) is a second order simultaneous differential equation, and if converted to a first order differential equation, is equivalent to equation (10).

$$\frac{d}{dt}\begin{bmatrix} \dot{x} \\ x \end{bmatrix} = \begin{bmatrix} -M^{-1}R & M^{-1}K \\ I & 0 \end{bmatrix}\begin{bmatrix} \dot{x} \\ x \end{bmatrix} + M^{-1}[\,1 \;\; 0 \;\; 0 \;\; 0 \;\; 0 \;\; 0\,]^T P \tag{10}$$

$$\frac{d}{dt}x = \dot{x} \tag{11}$$

Then, using the following equations (12), equation (2) is converted to equation (13).

$$X = \begin{bmatrix} \dot{x} \\ x \end{bmatrix}, A_u = \begin{bmatrix} -M^{-1}R & M^{-1}K \\ I & 0 \end{bmatrix}, \tag{12}$$

$$B_u = M^{+1}[\,1 \;\; 0 \;\; 0 \;\; 0 \;\; 0 \;\; 0\,]^T, U = P$$

$$\frac{d}{dt}X = A_a X + B_a U \tag{13}$$

Now, if Ca is as in the following equation (14), Y of the following equation (15) is the rate of volume change of the piezoelectric element 60.

$$Ca = [1\ 0\ 0\ 0\ 0\ 0] \tag{14}$$

$$Y = C_a X \tag{15}$$

Here, the variable vector x is referred to as a state variable, and the above equation (13) is referred to as an equation of state. The state observer model is an algorithm which estimates a state variable from an input U and an output Y.

Equation (15) is considered with an estimated state vector being X' and an observer gain being L.

$$\frac{d}{dt}X' = (A_a - LC_a)X' + B_aU + LY \tag{16}$$

If equation (13) is subtracted from the above equation (16), the following equation (17) is obtained.

$$\frac{d}{dt}(X - X') = (A_a - LC_a)(X - X') \tag{17}$$

The state vector X' which is estimated from the above equation (17) converges with the actual state vector X. A rate of this convergence is determined by the observer gain.

The above equation (16) is an equation which finds the state vector from a pressure force U and a volume change Y of the piezoelectric element 60. The state vector is estimated from the voltage applied to the resistor 30B and the piezoelectric element selection switch SW and the current that is detected in the above-described driving model of the piezoelectric head 12. From the definition of FIG. 6, a flow speed W of ink drops jetted from the nozzle 58 is provided by the following equation (18).

$$W=[1\ -1\ -1\ 0\ 0\ 0]X \tag{18}$$

Furthermore, a flow amount Z of the ink drops jetted from the nozzle 58 is provided by the following equation (19).

$$Z=[0\ 0\ 0\ 1\ -1\ -1]X \tag{19}$$

Now, how to determine the observer gain is problematic, but a Kalman filter can be utilized to determine the observer gain, in accordance with related literature (Kogou and Mita. 1979. "Shisutemu Seigyo Riron Nyuumon" ("An Introduction to System Control Theory"), published by Jikkyou Shuppan: pp 121-130, 173-178).

That is, utilizing a solution of a Riccatti matrix equation relating to S (the following equation (20)), with Q and R as weighting factors, L is provided by the following equation (21).

$$SA_a^T + A_aS - SC_a^TR^{-1}C_aS + Q = 0 \tag{20}$$

$$L = SC^TR^{-1} \tag{21}$$

Flow speeds and flow amounts of ink drops jetted from the nozzle 58 are estimated by the estimation method described above. Implementation of this estimation processing is divided between two types of signal processing at the DSP 40, state observer calculation processing and spectral analysis processing. This estimation processing is sequentially executed, to calculate time series data of flow speeds or flow amounts of ink drops jetted from the nozzle 58. The coefficients Aa, Ba, Ca and L of the state observer calculation (the above-mentioned equation (16)) are calculated in advance from design values of the acoustic vibration system and are stored at the DSP 40, or are provided from the CPU 42. Inputs of the state observer calculation are data u(n) (n=0,1,2 . . . ), which are proportional to pressures applied by the piezoelectric element 60, and data y(n) (n=0,1,2 . . . ), which are proportional to volume velocities. Outputs are the state vector X, the elements of which are a volume velocity $x_0$ of the piezoelectric element 60, a volume velocity $x_1$ of the ink supply channel 54, a volume velocity $x_2$ of the pressure chamber 56, a volume displacement $x_3$ of the piezoelectric element 60, a volume displacement $x_4$ of the ink supply channel 54, and a volume displacement $x_5$ of the pressure chamber 56. The flow speed of the ink drops jetted from the nozzle 58, that is, a volume velocity $x_6$ of the nozzle 58, is found by the following equation.

$$x_6 = x_0 - x_1 - x_2$$

The state observer calculation (the above-mentioned equation (16)) is a differential equation. Thus, there is discretization in accordance with a sampling period Ts, and it acts as a difference equation. Utilizing a method according to a zeroth order holder approximation in accordance with related literature (Mita. 1984. "Dejitaru Seigyo Riron" ("Digital Control Theory"), published by Shokodo: pp 7-20), a flow speed or flow amount of ink drops jetted from the nozzle 58 is estimated by the following equations (22) to (27).

$$\frac{d}{dt}X' = F_aX' + B_aU + LY \tag{22}$$

$$F_a = A_a - LC_a \tag{23}$$

$$X'((n+1)T_S) = F_dX'(nT_S) + B_dU(nT_S) + L_dY(nT_S) \tag{24}$$
$$n = 0, 1, 2, \ldots$$

$$F_d = \exp(F_aT_S) \tag{25}$$

$$B_d = \int_0^T \exp(F_at)B_a dt \tag{26}$$

$$L_d = \int_0^T \exp(F_at)L_a dt \tag{27}$$

For the spectral analysis processing, a fast Fourier transform (FFT) is employed. A relationship between a frequency resolution Δf, a data count N and the sampling duration is as follows.

$$\Delta f = N/Ts$$

An observation period T0 is as follows.

$$T0 = N \times Ts$$

Then, from a frequency characteristic which has been calculated by the spectral analysis of the estimated time series data of flow speeds or flow amounts of the ink drops jetted from the nozzle 58, a characteristic frequency and a refill frequency are found. On the basis of offsets thereof from the characteristic frequency and refill frequency at a time of proper ejection, an ejection failure or an ejection direction defect when the test signal was applied to the piezoelectric element 60 are judged for, and the CPU 42 is notified of judgment results. Because detection is possible from either of flow speeds and flow amounts of jetted ink drops, a case using flow speeds will be illustrated herebelow. The test signal represents the voltage that is applied to the piezoelectric element 60, and for the sake of convenience is set as a single-step signal, but need not necessarily be thus. The characteristic frequency and refill frequency at a time of proper ejection are experimentally determined in advance.

Figure 13A:
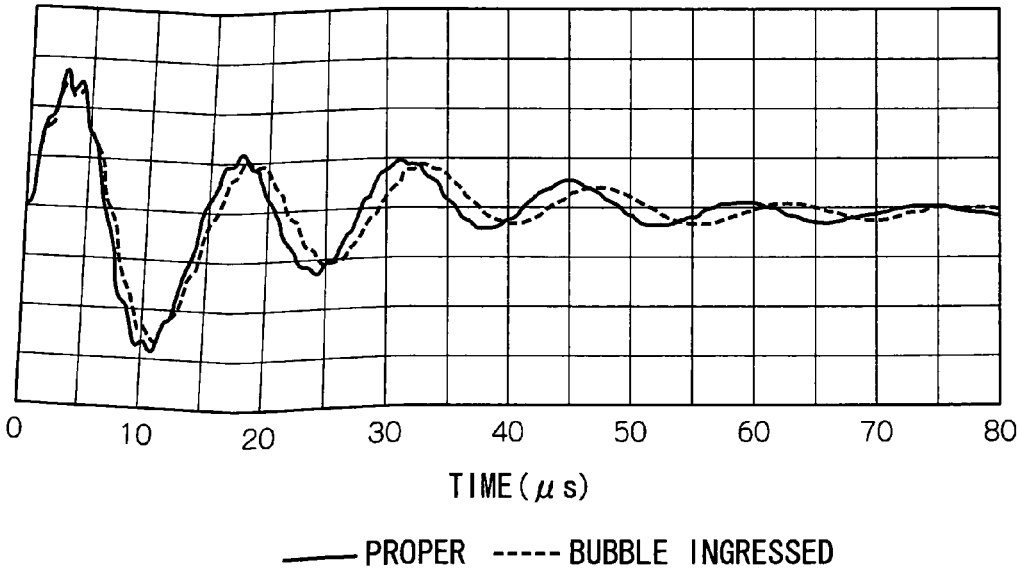
FIG. 13A is a graph showing a step response of flow speed of jetted ink drops in a case in which a bubble has ingressed.
Figure 13B:
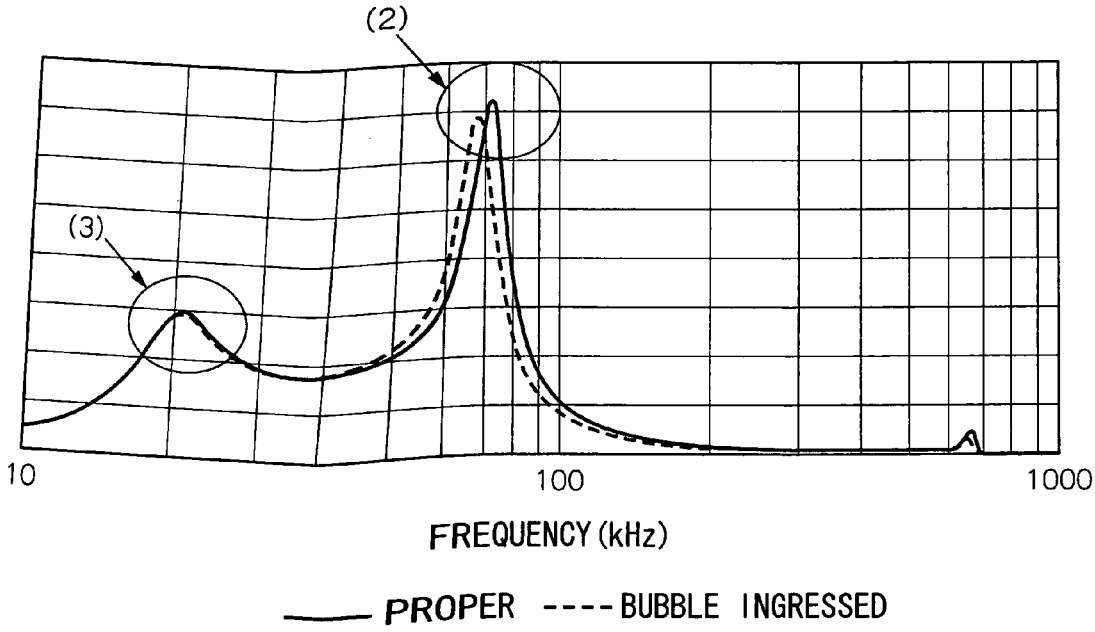
FIG. 13B is a graph showing a frequency characteristic of the flow speed of jetted ink drops in the case in which a bubble has ingressed.

A step response of flow speed of ink drops jetted from the nozzle 58 is, for example, as shown in FIG. 13A. In a case in which a frequency characteristic obtained by spectral analysis of the time series data of volume velocity is as shown in FIG. 13B, the characteristic frequency (peak 2) is altered, and the refill frequency (peak 3) is not altered (i.e., a change thereof is small). Therefore, it can be judged that a bubble has ingressed into the pressure chamber 56.

Figure 14A:
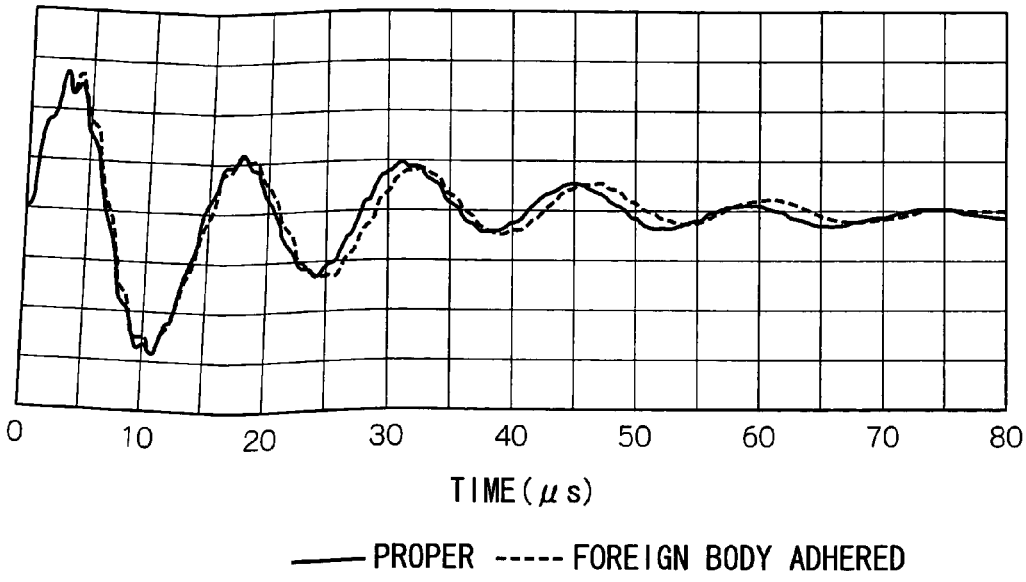
FIG. 14A is a graph showing a step response of flow speed of jetted ink drops in a case in which foreign matter has adhered.
Figure 14B:
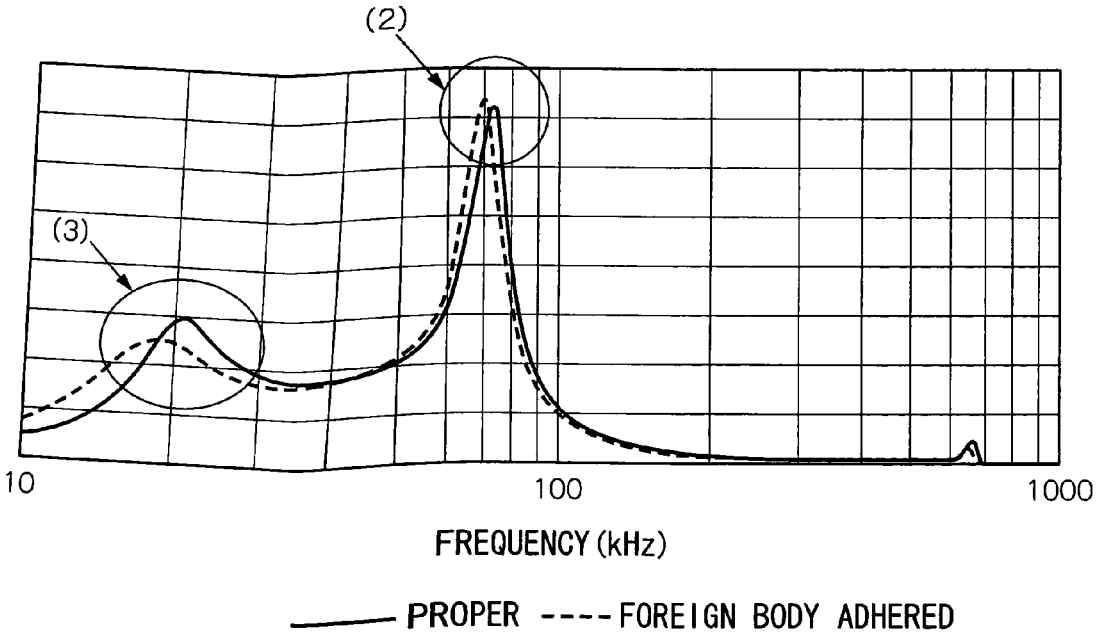
FIG. 14B is a graph showing a frequency characteristic of the flow speed of jetted ps in the case in which foreign matter has adhered.

Further, in a case in which the step response of flow speed of ink drops jetted from the nozzle 58 is as shown in FIG. 14A and the frequency characteristic obtained by spectral analysis of the time series data of volume velocity is as shown in FIG. 14B, the characteristic frequency (peak 2) is altered, and the refill frequency (peak 3) is greatly altered. Therefore, it can be judged that foreign matter has adhered to the face of the nozzle 58 or that a fabrication condition, such as the nozzle shape, a water-repellence treatment or the like, is defective.

Then, maintenance operations, image processing and the like are implemented by the CPU 42 of the control unit 62 on the basis of the judgment results that the DSP 40 has provided. In a case in which moderate ejection failures are judged (i.e., changes in the characteristic frequencies are small), a driving waveform of the piezoelectric heads 12 is corrected or altered, and in a case in which there are few piezoelectric heads 12 with ejection failures, image defects can be compensated for by image processing. If there are many piezoelectric heads 12 with ejection failures, maintenance by suction is carried out, and if there are many piezoelectric heads 12 with ejection direction defects, the operation of maintenance by wiping is carried out.

As described above, according to the inkjet recording device relating to the first exemplary embodiment, the equation of state is utilized, and the flow speeds or flow amounts of ink drops are estimated on the basis of the voltages that are applied to the piezoelectric element selection switches and resistor of the bridge circuit and the output voltages from the differential amplifier when these voltages are applied to the piezoelectric element selection switches and the resistor. From shifts of the resonance points of the frequency characteristics of flow speed or flow amount of ink drops, causes of defective ejections at the piezoelectric heads can be judged for. Therefore, causes of defective ejections can be detected.

From offsets of the resonance points which occur when bubbles ingress into the pressure chambers, when foreign matter adheres to the nozzles, and the like, it is possible to judge for causes of defective ejections.

Because it is sufficient to provide just the bridge circuit, which includes the capacitor corresponding to the damping capacitances of the piezoelectric elements and the resistor corresponding to the on-resistances of the piezoelectric element selection switches, and the differential amplifier which amplifies the differential voltage, a simple structure is possible. Furthermore, the apparatus for judging for causes of defective ejections at the nozzles can be easily incorporated into an inkjet recording device.

Further, in a case in which a defective ejection cause that is detected is ingression of an air bubble and an ejection failure due to the ingression of the air bubble is slight, a voltage driving waveform can be corrected to eliminate the ejection failure.

Further, in a case in which a defective ejection cause is ingression of air bubbles and there are only a few piezoelectric heads at which air bubbles have ingressed, image defects due to ejection failures can be compensated for by image processing.

Further, in a case in which a defective ejection cause is ingression of air bubbles and there are many nozzles at which ejection failures have been caused by the ingression of air bubbles, the ejection failures can be eliminated by suction of the air bubbles. Further, in a case in which a defective ejection cause is adherence of foreign matter and there are many nozzles at which ejection direction defects have been caused by the adherence of foreign matter, the foreign matter can be removed and the ejection direction defects eliminated by wiping.

For the exemplary embodiment described above, a case of utilizing an FFT to perform spectral analysis processing has been described as an example. However, utilizing a wavelet transform to perform the spectral analysis processing is also possible.

Hereafter, a second exemplary embodiment will be described. Portions that are the same as in the first exemplary embodiment are assigned the same reference numerals and will not be described. For the second exemplary embodiment, a case of application of the present invention to an inspection device for a head fabrication process will be described.

In the inspection device relating to this second exemplary embodiment, for the piezoelectric head 12 that has been fabricated, time series data of flow speeds or flow amounts of ink drops jetted from the nozzle 58 are estimated. The time series data of flow speeds or flow amounts of ink drops is spectrum-analyzed, and the characteristic frequency and refill frequency are found. On the basis of offsets from the characteristic frequency and refill frequency of a case without defective ejections, judgment of whether the piezoelectric head 12 is satisfactory or not is carried out.

Thus, because the condition of a piezoelectric head can be understood from the characteristic frequency and the refill frequency, by applying the present invention to an inspection device of a head fabrication process, it is possible to carry out pass-fail judgments of piezoelectric heads.

What is claimed is:

1. An inspection device for a piezoelectric head that includes a pressure chamber filled with liquid, a liquid supply channel that supplies the liquid to the pressure chamber, a nozzle at which droplets are jetted from the pressure chamber, and a piezoelectric element that applies pressure to the pressure chamber, the inspection device comprising:

a detection component that, when the piezoelectric element is driven on the basis of a predetermined detection signal, outputs a signal corresponding to behavior of an acoustic vibration system of the piezoelectric head; and a judgment component that, on the basis of the detection signal and the signal outputted by the detection component, judges for a cause of defective ejections at the piezoelectric head;

wherein the detection component calculates a rate of volume change of the piezoelectric element on the basis of the signal corresponding to behavior of the acoustic vibration system, on the basis of an equation of state that represents the acoustic vibration system of the piezoelectric head, calculates, from the detection signal and the calculated rate of volume change, time series data of at least one of flow speed and flow amount of droplets that are jetted from the nozzle, and judges for a cause of defective ejections at the piezoelectric head on the basis of a frequency characteristic of the calculated time series data;

wherein the equation of state is the following equation:

$$P = M\frac{d^2x}{dt^2} + R\frac{dx}{dt^2} + Kx$$

in which: given that volume changes of the piezoelectric element, the pressure chamber, the liquid supply channel and the nozzle are designated x0, x1, x2 and x3, respectively, with the relationship x0=x1+x2+x3, x is a state vector constituted with x0 and any two of the variables x1, x2 and x3; M is an inertia matrix of the piezoelectric element, liquid supply channel, pressure chamber and nozzle of the acoustic vibration system, R is a viscosity matrix of the same and K is a rigidity matrix of the same; and P is a pressure vector that the piezoelectric element applies to the pressure chamber when voltage is applied to a switching element of a bridge circuit of the detection component.

2. An inspection device for a piezoelectric head that includes a pressure chamber filled with liquid, a liquid supply channel that supplies the liquid to the pressure chamber, a nozzle at which droplets are jetted from the pressure chamber, and a piezoelectric element that applies pressure to the pressure chamber, the inspection device comprising:

a detection component that, when the piezoelectric element is driven on the basis of a predetermined detection signal, outputs a signal corresponding to behavior of an acoustic vibration system of the piezoelectric head; and a judgment component that, on the basis of the detection signal and the signal outputted by the detection component, judges for a cause of defective ejections at the piezoelectric head;

wherein the detection component calculates a rate of volume change of the piezoelectric element on the basis of the signal corresponding to behavior of the acoustic vibration system, on the basis of an equation of state that represents the acoustic vibration system of the piezoelectric head, calculates, from the detection signal and the calculated rate of volume change, time series data of at least one of flow speed and flow amount of droplets that are jetted from the nozzle, and judges for a cause of defective ejections at the piezoelectric head on the basis of a frequency characteristic of the calculated time series data;

wherein the judgment component, on the basis of offsets between a plurality of resonance points that occur in the frequency characteristic of the calculated time series data and a pre-specified plurality of resonance points that occur in a frequency characteristic of time series data when proper ejections from the piezoelectric head are performed, judges for at least one of whether or not a bubble has ingressed into the pressure chamber, liquid supply channel or nozzle, whether or not foreign matter has adhered to the nozzle, and whether or not a fabrication condition is satisfactory.

3. A droplet jetting device comprising:

a piezoelectric head that includes a pressure chamber filled with liquid, a liquid supply channel that supplies the liquid to the pressure chamber, a nozzle at which droplets are jetted from the pressure chamber, and a piezoelectric element that applies pressure to the pressure chamber; and an inspection device that includes a detection component that, when the piezoelectric element is driven on the basis of a predetermined detection signal, outputs a signal corresponding to behavior of an acoustic vibration system of the piezoelectric head on the basis of an equation of state, and a judgment component that, on the basis of the detection signal and the signal outputted by the detection component, judges for a cause of defective ejections at the piezoelectric heady, wherein the equation of state is the following equation:

$$P = M\frac{d^2x}{dt^2} + R\frac{dx}{dt^2} + Kx$$

in which: given that volume changes of the piezoelectric element, the pressure chamber, the liquid supply channel and the nozzle are designated x0, x1, x2 and x3, respectively, with the relationship x0=x1+x2+x3, x is a state vector constituted with x0 and any two of the variables x1, x2 and x3; M is an inertia matrix of the piezoelectric element, liquid supply channel, pressure chamber and nozzle of the acoustic vibration system, R is a viscosity matrix of the same and K is a rigidity matrix of the same; and P is a pressure vector that the piezoelectric element applies to the pressure chamber when voltage is applied to a switching element of a bridge circuit of the detection component.

4. The droplet jetting device of claim 3 further comprising a correction component that corrects a driving waveform of voltage applied to the piezoelectric head on the basis of results from the judgment component.

5. The droplet jetting device of claim 3 further comprising a compensation component that performs image processing so as to compensate for image defects due to defective ejections of the piezoelectric head on the basis of results from the judgment component.

6. The droplet jetting device of claim 3 further comprising:

a defective ejection amelioration component that executes at least one of suction of a bubble that has ingressed into the pressure chamber and wiping that removes foreign matter that has adhered at the nozzle; and a control component that causes the defective ejection amelioration component to execute at least one of the suction and the wiping on the basis of results from the judgment component.

* * * * *